US008563925B2

(12) United States Patent
Kanai et al.

(10) Patent No.: US 8,563,925 B2
(45) Date of Patent: Oct. 22, 2013

(54) MASS SPECTROSCOPE AND ITS ADJUSTING METHOD

(71) Applicant: Hitachi High-Technologies Corporation, Tokyo (JP)

(72) Inventors: Hisaaki Kanai, Yokohama (JP); Fujio Ohnishi, Yokohama (JP); Masami Makuuchi, Yokohama (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 13/722,421

(22) Filed: Dec. 20, 2012

(65) Prior Publication Data

US 2013/0200256 A1 Aug. 8, 2013

(30) Foreign Application Priority Data

Feb. 6, 2012 (JP) ..... 2012-022940

(51) Int. Cl.
*H01J 49/00* (2006.01)

(52) U.S. Cl.
CPC ..... *H01J 49/00* (2013.01)
USPC ..... 250/292; 250/290

(58) Field of Classification Search
USPC ..... 250/292, 290
See application file for complete search history.

(56) References Cited

U.S. PATENT DOCUMENTS 6,844,547 B2 * 1/2005 Syka ..... 250/292

FOREIGN PATENT DOCUMENTS

JP 2001-332211 A 11/2001

* cited by examiner

*Primary Examiner* — Kiet T Nguyen
(74) *Attorney, Agent, or Firm* — Crowell & Moring LLP

(57) ABSTRACT

In order to enable the mass spectroscope to reduce the operation load of the adjustment of the amplitude difference, and to reduce the increase in power consumption caused by the difference between the resonance frequency and the drive frequency, the resonance circuit unit of the ion trap section is configured to control the amplitude difference adjustment section of the resonance circuit unit to adjust that the amplitude difference between the high-voltage RF signals decreases, and controls the frequency synchronizing section of the resonance circuit unit to adjust that the resonance frequency of the resonance circuit is aligned with the drive frequency of the RF signal source, on the basis of the information about the amplitude difference between the high-voltage RF signals and the resonance frequency of the resonance circuit unit, which have been measured by a resonance frequency/amplitude difference measuring unit.

14 Claims, 10 Drawing Sheets

MASS SPECTROSCOPE AND ITS ADJUSTING METHOD

INCORPORATION BY REFERENCE

The present application claims priority from Japanese application serial No. 2012-22940, filed on Feb. 6, 2012, the entire contents of which are hereby incorporated by reference into this application.

BACKGROUND

The present invention relates to a mass spectroscope which includes an ion trap section having a function of trapping ions, and is used to identify the composition of a substance. The invention also relates to a method for adjusting the mass spectroscope.

The ion trap section of the mass spectroscope is constituted of a plurality of electrodes each having a hyperboloidal cross-sectional shape. By applying a high-voltage high-frequency signal (hereinafter, referred to as "high-voltage RF signal") and a direct current voltage to the electrode, an electric field is generated in the space formed by the plurality of electrodes, thereby trapping ions.

The principles of trapping ions by the ion trap section will be described with reference to FIG. 9. Here, a rod electrode section 905, which is configured by disposing in parallel four electrode columns (hereinafter referred to as "rod electrodes") 908*a*-1, 908*a*-2, 908*b*-1, and 908*b*-2 each having a hyperboloidal cross-sectional shape, is taken as an example of the ion trap section. In addition, a circuit which is taken as an example of a high-voltage RF signal generating circuit includes: an RF signal source 901 which outputs a high frequency signal (hereinafter referred to as "RF signal"); and a resonance circuit 906 formed of coils 902*a* and 902*b*, capacitors 903*a*, 903*b*, and 904, a parasitic capacitor of wiring and the like.

On the assumption that with respect to the central axis of the four rod electrodes 908*a*-1, 908*a*-2, 908*b*-1, and 908*b*-2, an in-phase high-voltage RF signal is applied to one rod electrode pair 908*a*-1 and 908*a*-2 which face each other, whereas a reversed-phase high-voltage RF signal is applied to the other rod electrode pair 908*b*-1 and 908*b*-2, the motion equation of ions on the x-y plane which is orthogonal to the central axis is represented by the following equations:

$$\frac{dx^2}{d\xi^2} + 2q\cos(2\xi)x = 0 \quad \text{(Equation 1)}$$

$$\frac{dy^2}{d\xi^2} + 2q\cos(2\xi)y = 0 \quad \text{(Equation 2)}$$

$$\xi = \frac{\omega t}{2} \quad \text{(Equation 3)}$$

$$q = \frac{8\ \text{eV}}{mr_0^2\omega^2} \quad \text{(Equation 4)}$$

Here, e is the quantity of electric charge of ions; V is the amplitude of the high-voltage RF signal; m is the mass number of ions; $r_0$ is the radius of the inscribed circle which inscribes the space surrounded by the rod electrodes; ω is the angular frequency of the high-voltage RF signal; and t is the time.

In general, it is well known that in order to trap ions, the mass-to-charge ratio of which is m/e, into an ion trap, V and ω have only to be determined in such a manner that $q \leq 0.908$.

However, even if V and ω are determined as described above, manufacturing errors of the inductance of a coil and a capacitor connected to each rod electrode pair, and the like, may cause a difference in amplitude between the high-voltage RF signals applied to the rod electrode pairs respectively. In such a case, the motion equations (equations 1 and 2) are not satisfied, and therefore, there is a case where the efficiency of trapping ions decreases, or a case where ions having a desired mass-to-charge ratio cannot be trapped.

As a solution for solving this problem, JP-A-2001-332211 (Patent Document 1) discloses a linear ion trap apparatus, wherein an ion trap is constituted of four rod electrodes, each of the rod electrodes has a variable capacitor, and each variable capacitor is configured to be adjustable in such a manner that the high-frequency voltages become equivalent to one another.

FIGS. 10A and 10B are graphs each illustrating the relationship between the resonance frequency and the drive frequency measured when any of the variable capacitors which are connected to the rod electrodes respectively is adjusted to adjust the amplitude difference between the high-voltage RF signals. FIG. 10A illustrates frequency characteristics of the high-voltage RF signals measured when the frequency synchronizing unit makes the resonance frequency $f_R$ and the drive frequency $f_D$ equivalent to each other in a state in which the amplitude difference between the high-voltage RF signals is not corrected. It is revealed that there is a large difference in amplitude between the high-voltage RF signals of the rod electrode pairs at the resonance frequency. FIG. 10B illustrates the frequency characteristics measured when the amplitude difference between the high-voltage RF signals has been corrected by a variable capacitor from the state shown in FIG. 10A. It is revealed that although the amplitude difference decreases by the correction of the amplitude difference, the resonance frequency and the drive frequency are not equivalent to each other.

Therefore, in order to make the resonance frequency $f_R$ and the drive frequency $f_D$ equivalent to each other, it is necessary to further adjust another variable capacitor, which produces the problem of increasing the operation load of the adjustment. In addition, when the ion trap apparatus is operated in the state in which the resonance frequency and the drive frequency are not equivalent to each other, the amplification factor may decrease, which causes the power consumption to increase, or the operation margin of the circuit may decrease, which causes the ion trap apparatus to operate abnormally.

SUMMARY

The present invention has been made to solve the above-mentioned problems, and an object of the present invention is to reduce a difference between the resonance frequency and the drive frequency even when the amplitude difference between the high-voltage RF signals has been adjusted, thereby reducing the operation load of the adjustment of the amplitude difference, and thereby reducing the decrease in amplification factor caused by the difference between the resonance frequency and the drive frequency.

In order to solve the abovementioned problems, according to one aspect of the present invention, there is provided a mass spectroscope comprising: a sample introduction chamber for introducing therein a sample; an ionization chamber for ionizing the sample which has been introduced into the sample introduction chamber; an ion trap section for separating the sample ionized in the ionization chamber according to the mass of the ions; a detector for detecting ions having predetermined mass among the ions separated in the ion trap section; and a data processing unit for processing data obtained as the result of detecting the ions by the detector. The ion trap section includes: a rod electrode section having two pairs of rod electrodes (four rod electrodes in total), each pair of rod electrodes being disposed in such a manner that the rod electrodes of the pair face each other; an RF signal source for generating an RF signal; a resonance circuit unit for resonating and amplifying the RF signal generated by the RF signal source to generate a high-voltage RF signal, applying the high-voltage RF signal to one of the two rod electrode pairs, and applying the high-voltage RF signal, the phase of which is reversed from that of the high-voltage RF signal applied to the one of the two rod electrode pairs, to the other of the two rod electrode pairs, the rod electrodes of each rod electrode pair facing each other with respect to the central axis of the four rod electrodes of the rod electrode section; a resonance frequency/amplitude difference measuring unit for measuring an amplitude difference between the high-voltage RF signal applied to the one of the two rod electrode pairs and the reversed-phase high-voltage RF signal applied to the other of the two rod electrode pairs, and measuring a resonance frequency of the resonance circuit unit; and a control unit for adjusting the resonance circuit unit on the basis of information about the amplitude difference between the high-voltage RF signals and the resonance frequency of the resonance circuit unit. The resonance circuit unit includes: a frequency synchronizing section for synchronizing the drive frequency of the RF signal source and the resonance frequency of the resonance circuit with each other; and an amplitude difference adjustment section for adjusting the amplitude difference between the high-voltage RF signals to a predetermined value. The control unit controls the amplitude difference adjustment section of the resonance circuit unit to perform adjustment in such a manner that the amplitude difference between the high-voltage RF signals decreases, and controls the frequency synchronizing section of the resonance circuit unit to perform adjustment in such a manner that the resonance frequency of the resonance circuit is aligned with the drive frequency of the RF signal source, on the basis of the information about the amplitude difference between the high-voltage RF signals and the resonance frequency of the resonance circuit unit.

In addition, in order to solve the above-mentioned problems, according to another aspect of the present invention, there is provided a mass spectroscope comprising: a sample introduction chamber for introducing therein a sample; an ionization chamber for ionizing the sample which has been introduced into the sample introduction chamber; an ion trap section for separating the sample ionized in the ionization chamber according to the mass of the ions; a detector for detecting ions having predetermined mass among the ions separated in the ion trap section; and a data processing unit for processing data obtained as the result of detecting the ions by the detector. The ion trap section includes: a rod electrode section having two pairs of rod electrodes (four rod electrodes in total), each pair of rod electrodes being disposed in such a manner that the rod electrodes of the pair face each other; an RF signal source for generating an RF signal; a resonance circuit unit for resonating and amplifying the RF signal generated by the RF signal source to generate a high-voltage RF signal, applying the high-voltage RF signal to one of the two rod electrode pairs, and applying the high-voltage RF signal, the phase of which is reversed from that of the high-voltage RF signal applied to the one of the two rod electrode pairs, to the other of the two rod electrode pairs, the rod electrodes of each rod electrode pair facing each other with respect to the central axis of the four rod electrodes of the rod electrode section; a resonance frequency/amplitude difference measuring unit for measuring an amplitude difference between the high-voltage RF signal applied to the one of the two rod electrode pairs and the reversed-phase high-voltage RF signal applied to the other of the two rod electrode pairs, and measuring a resonance frequency of the resonance circuit unit; and a control unit for adjusting the resonance circuit unit on the basis of information about the amplitude difference between the high-voltage RF signals and the resonance frequency of the resonance circuit unit. The resonance circuit unit includes: a frequency synchronizing section for synchronizing the drive frequency of the RF signal source and the resonance frequency of the resonance circuit with each other; and an amplitude difference adjustment section for adjusting the amplitude difference between the high-voltage RF signals to a predetermined value. The control unit includes: an amplitude difference control section for controlling the amplitude difference adjustment section of the resonance circuit unit on the basis of the information about the amplitude difference between the high-voltage RF signals and the resonance frequency of the resonance circuit unit; and a frequency synchronization control section for controlling the frequency synchronizing section of the resonance circuit unit.

Moreover, in order to solve the above-mentioned problems, according to still another aspect of the present invention, there is provided a method for adjusting a mass spectroscope, the method comprising the steps of: resonating and amplifying, by a resonance circuit, an RF signal generated by an RF signal source to generate a high-voltage RF signal; providing a rod electrode section with two pairs of rod electrodes (four rod electrodes in total), each pair of rod electrodes being disposed in such a manner that the rod electrodes of the pair face each other with respect to the central axis of the four rod electrodes, applying the generated high-voltage RF signal to one of the two rod electrode pairs, and applying the generated high-voltage RF signal to the other of the two rod electrode pairs with the phase of the high-voltage RF signal reversed from that of the high-voltage RF signal applied to the one of the two rod electrode pairs; measuring an amplitude difference between the high-voltage RF signal applied to the one of the two rod electrode pairs and the reversed-phase high-voltage RF signal applied to the other of the two rod electrode pairs, and a resonance frequency of the resonance circuit; and adjusting the resonance circuit on the basis of information about the measured amplitude difference between the high-voltage RF signals and the measured resonance frequency of the resonance circuit. On the basis of the information about the amplitude difference between the high-voltage RF signal applied to one of the two rod electrode pairs and the reversed-phase high-voltage RF signal applied to the other of the two rod electrode pairs, and the information about the resonance frequency of the resonance circuit, the resonance circuit is adjusted in such a manner that the amplitude difference decreases, and in such a manner that the resonance frequency of the resonance circuit is aligned with a frequency of the RF signal.

Furthermore, in order to solve the above-mentioned problems, according to a further aspect of the present invention, there is provided a method for adjusting a mass spectroscope that includes a rod electrode section having two pairs of rod electrodes (four rod electrodes in total), each pair of rod electrodes being disposed in such a manner that the rod electrodes of the pair face each other, the method comprising the steps of: detecting a resonance frequency of a resonance circuit which resonates and amplifies an RF signal generated by an RF signal source to generate a high-voltage RF signal; setting a drive frequency of an RF signal source in such a manner that the drive frequency is synchronized with the detected resonance frequency of the resonance circuit; resonating and amplifying, by the resonance circuit, an RF signal generated by the RF signal source at the set drive frequency, thereby generating a high-voltage RF signal; providing a rod electrode section with two pairs of rod electrodes, each pair of rod electrodes being disposed in such a manner that the rod electrodes of the pair face each other with respect to the central axis of the four rod electrodes, applying the generated high-voltage RF signal to one of the two rod electrode pairs, and applying the generated high-voltage RF signal to the other of the two rod electrode pairs with the phase of the high-voltage RF signal reversed from that of the high-voltage RF signal applied to the one of the two rod electrode pairs; detecting an amplitude difference between the high-voltage RF signal applied to the one of the two rod electrode pairs and the reversed-phase high-voltage RF signal applied to the other of the two rod electrode pairs; comparing the detected amplitude difference with a predetermined value; when the detected amplitude difference is larger than the predetermined value, adjusting the resonance circuit in such a manner that the amplitude difference decreases; and when the detected amplitude difference is smaller than or equal to the predetermined value, setting a correction coefficient of a mass spectrum according to the drive frequency.

According to the representative invention among the inventions disclosed in the present application, since the difference between the resonance frequency and the drive frequency, which is caused by the adjustment of the amplitude difference adjusting unit, can be suppressed, the mass spectroscope can be stably operated even when the temperature or the humidity has changed. Moreover, since the adjustment time can be shortened, the measurement throughput of the mass spectroscope can be improved.

These features and advantages of the invention will be apparent from the following more particular description of preferred embodiments of the invention, as illustrated in the accompanying drawings.

DESCRIPTION OF THE PREFERRED EMBODIMENTS

Figure 1:
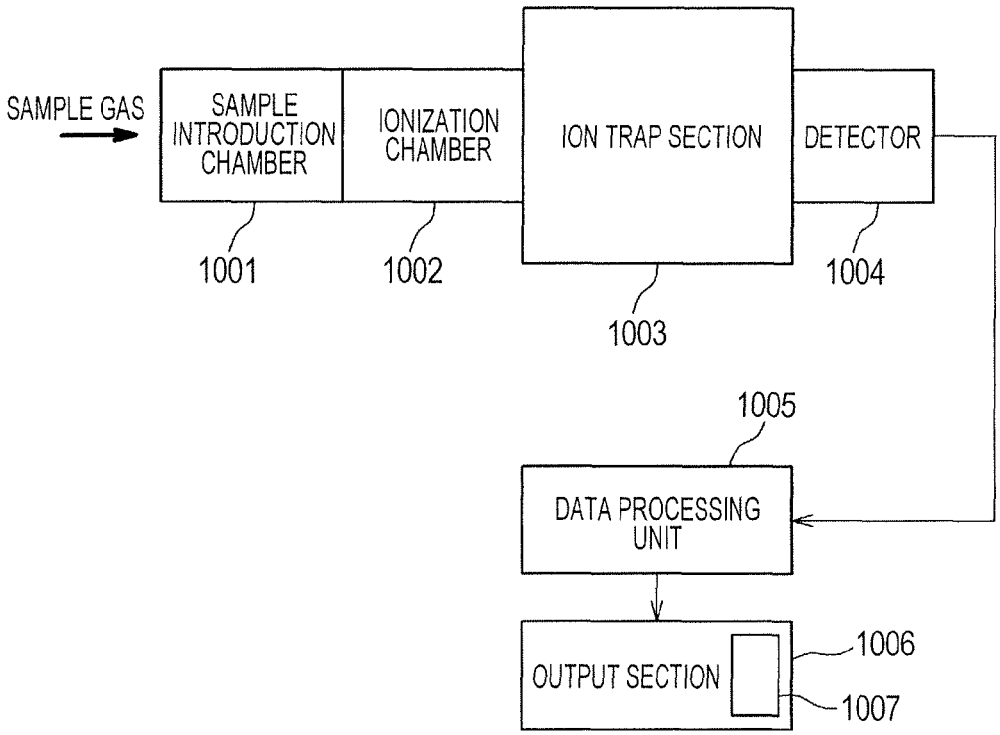
FIG. 1 is a block diagram illustrating a configuration of a mass spectroscope according to the present invention.

FIG. 1 is a diagram illustrating a configuration of a mass spectroscope to which an ion trap apparatus of the present invention is applied. The mass spectroscope is composed of a sample introducing chamber 1001, an ionization chamber 1002, an ion trap section 1003, a detector 1004 and a data processing unit 1005. A sample gas is introduced into the sample introduction chamber 1001, and is then ionized in the ionization chamber 1002. The ionized sample is transferred to the ion trap section 1003. In the ion trap section 1003, ions are accumulated, and the mass scan operation is performed for the purpose of obtaining a mass spectrum. Ions emitted from the ion trap section 1003 by the mass scan are converted into an electric signal by the detector 1004. The electric signal is corrected by software in the data processing unit 1005 to obtain a mass spectrum, the result thereof is then transmitted to an output section 1006, and information about the mass spectrum is displayed on a screen 1007.

Next, embodiments illustrating how the ion trap section 1003 is configured will be described as below.

First Embodiment

Figure 2:
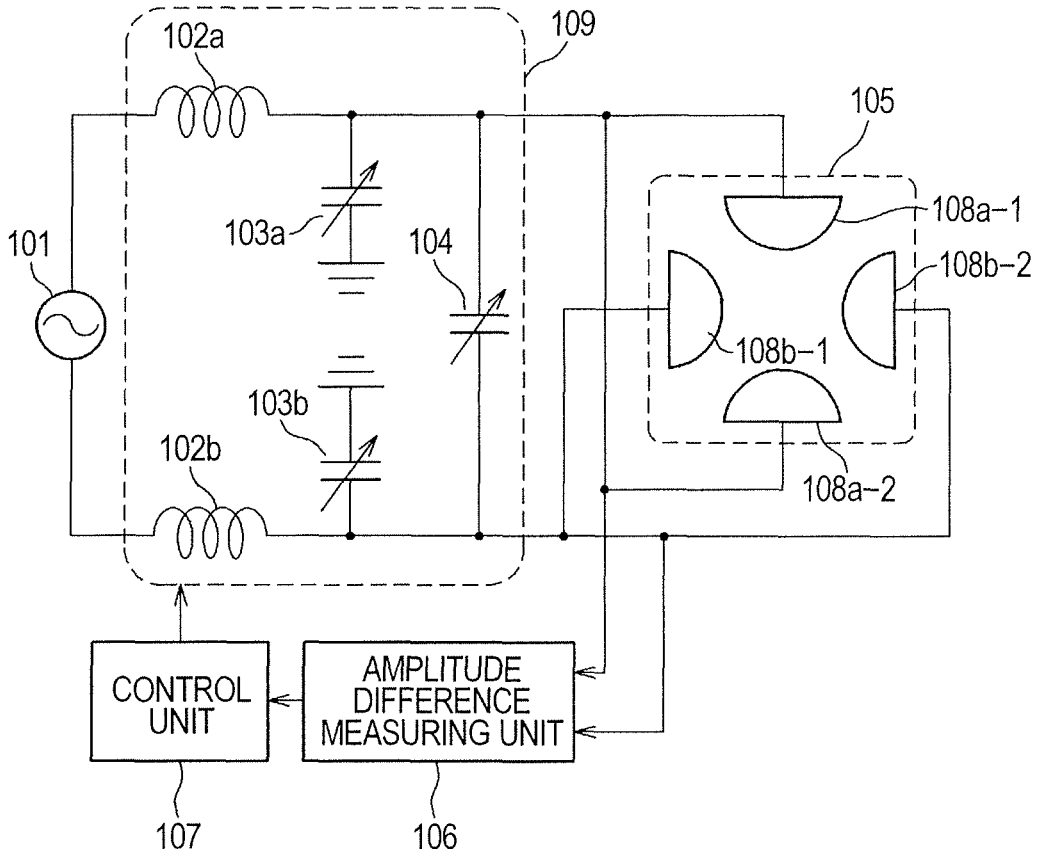
FIG. 2 is a block diagram illustrating a configuration of an ion trap section according to the first embodiment of the present invention.

FIG. 2 is a diagram illustrating a configuration of the ion trap section 1003 according to a first embodiment of the present invention. The ion trap section 1003 according to the first embodiment includes an RF signal source 101, a rod electrode section 105, a resonance frequency/amplitude difference measuring unit 106, a control unit 107 and a resonance circuit section 109.

The RF signal source 101 generates a high frequency signal (RF signal). The rod electrode section 105 has two pairs of rod electrodes (four rod electrodes in total), each pair of rod electrodes being disposed in parallel with and facing each other (in other words, the rod electrode section 105 has one rod electrode pair 108*a*-1, 108*a*-2 which face each other, and the other rod electrode pair 108*b*-1, 108*b*-2 which face each other, with respect to the central axis of the rod electrodes).

The resonance circuit 109 includes coils 102*a*, 102*b*, variable capacitors 103*a*, 103*b*, 104 and the parasitic capacitance of wiring.

The resonance circuit 109 resonates and amplifies the RF signal generated by the RF signal source 101 to generate a high-voltage RF signal, then applies the in-phase high-voltage RF signal to the one rod electrode pair 108*a*-1, 108*a*-2 of the rod electrode section 105, and applies the reversed-phase high-voltage RF signal to the other rod electrode pair 108*b*-1, 108*b*-2. The variable capacitors 103*a*, 103*b* of the resonance circuit 109 function as amplitude difference adjusting units for adjusting the amplitude difference of the high-voltage RF signal generated by the RF signal source 101 to a predetermined value (hereinafter, referred to as "amplitude difference adjusting units 103*a*, 103*b*"). The variable capacitor 104 functions as a frequency synchronizing unit for synchronizing a drive frequency of the high-voltage RF signal generated by the RF signal source 101 and a resonance frequency of a resonance circuit with each other (hereinafter, referred to as "frequency synchronizing unit 104").

The resonance frequency/amplitude difference measuring unit 106 receives the high-voltage RF signal, which is generated by the RF signal source 101 and is then applied to the one rod electrode pair 108*a*-1, 108*a*-2, and the high-voltage RF signal, which is applied to the other rod electrode pair 108*b*-1, 108*b*-2 and has a phase reversed from that of the high-voltage RF signal applied to the one rod electrode pair 108*a*-1, 108*a*-2, and then measures the amplitude difference between the high-voltage RF signals and a resonance frequency of the resonance circuit.

The control unit 107 adjusts the amplitude difference adjusting units 103*a*, 103*b* and the frequency synchronizing unit 104 on the basis of the result of the amplitude difference between the in-phase high-voltage RF signal applied to the one rod electrode pair 108*a*-1, 108*a*-2 and the reversed-phase high-voltage RF signal applied to the other rod electrode pair 108*b*-1, 108*b*-2, and the result of the resonance frequency of the resonance circuit, which have been measured by the amplitude difference measuring unit 106. In other words, on the basis of the measurement result of the resonance frequency of the resonance circuit, the control unit 107 controls the frequency synchronizing unit 104 to correct a difference in frequency between the drive frequency and the resonance frequency in such a manner that the resonance frequency of the resonance circuit 109 is aligned with the drive frequency of the high-voltage RF signal generated by the RF signal source 101. At the same time, the control unit 107 adjusts the amplitude difference adjusting unit 106 in such a manner that the amplitude difference between the in-phase high-voltage RF signal applied to the one rod electrode pair 108*a*-1, 108*a*-2 and the reversed-phase high-voltage RF signal applied to the other rod electrode pair 108*b*-1, 108*b*-2 decreases.

In particular, when the amplitude difference adjusting units 103*a*, 103*b* are controlled in such a manner that the resonance frequency of the resonance circuit 109 is shifted to the low frequency side, the frequency difference between the drive frequency of the high-voltage RF signal and the resonance frequency of the resonance circuit 109 can be corrected by controlling the frequency synchronizing unit 104 in such a manner that the resonance frequency of the resonance circuit 109 is shifted to the high frequency side.

Figure 3A:
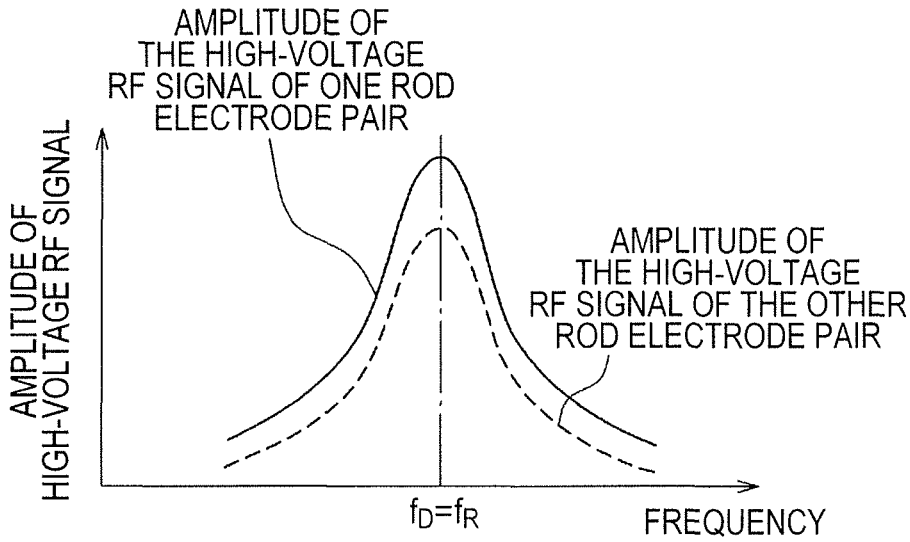
FIG. 3A is a graph illustrating the relationship between the resonance frequency and the drive frequency before the amplitude of a high-voltage RF signal is adjusted.
Figure 3B:
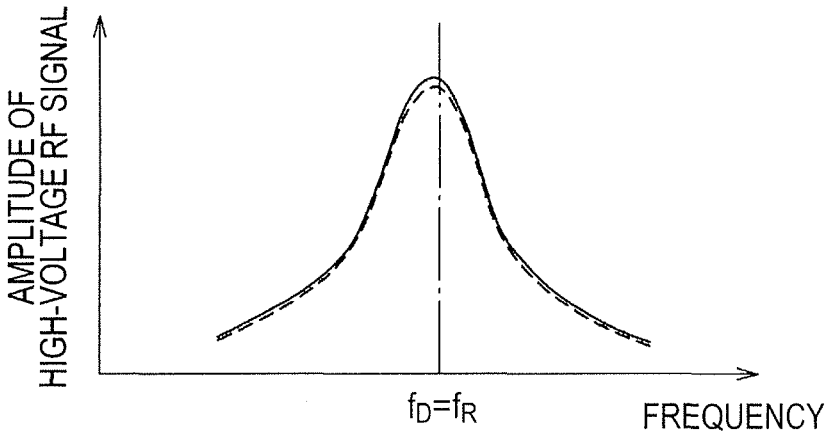
FIG. 3B is a graph illustrating the relationship between the resonance frequency and the drive frequency measured when the amplitude of the high-voltage RF signal is adjusted by applying the ion trap section according to the first embodiment of the present invention.

FIGS. 3A and 3B are diagrams each illustrating the relationship between the resonance frequency and the drive frequency measured when the amplitude of the high-voltage RF signal is adjusted according to this embodiment. FIG. 3A illustrates frequency characteristics of the high-voltage RF signals measured when the frequency synchronizing unit makes the resonance frequency $f_R$ and the drive frequency $f_D$ equivalent to each other in a state in which the amplitude difference between the high-voltage RF signals is not corrected. FIG. 3B illustrates frequency characteristics of the high-voltage RF signal amplitudes measured when the amplitude difference is corrected from the state of FIG. 3A according to the present embodiment. It is revealed that even when the amplitude difference is corrected, the resonance frequency $f_R$ and the drive frequency $f_D$ are equivalent to each other.

In this embodiment, variable capacitors are taken as an example of the amplitude difference adjusting units 103*a*, 103*b* and the frequency synchronizing unit 104. However, as a mode of the variable capacitors, variable capacitors, each of which is configured to be capable of adjusting a capacitance value thereof by a volume control or to be capable of switching the capacitance value thereof by a switch, can also achieve the effects of the present invention. In addition, as an alternative to the variable capacitors, a configuration in which, for example, the inductance of coils can be adjusted, and the inductance is controlled according to the result of measuring the amplitude difference can also achieve the similar effects.

Second Embodiment

Figure 4:
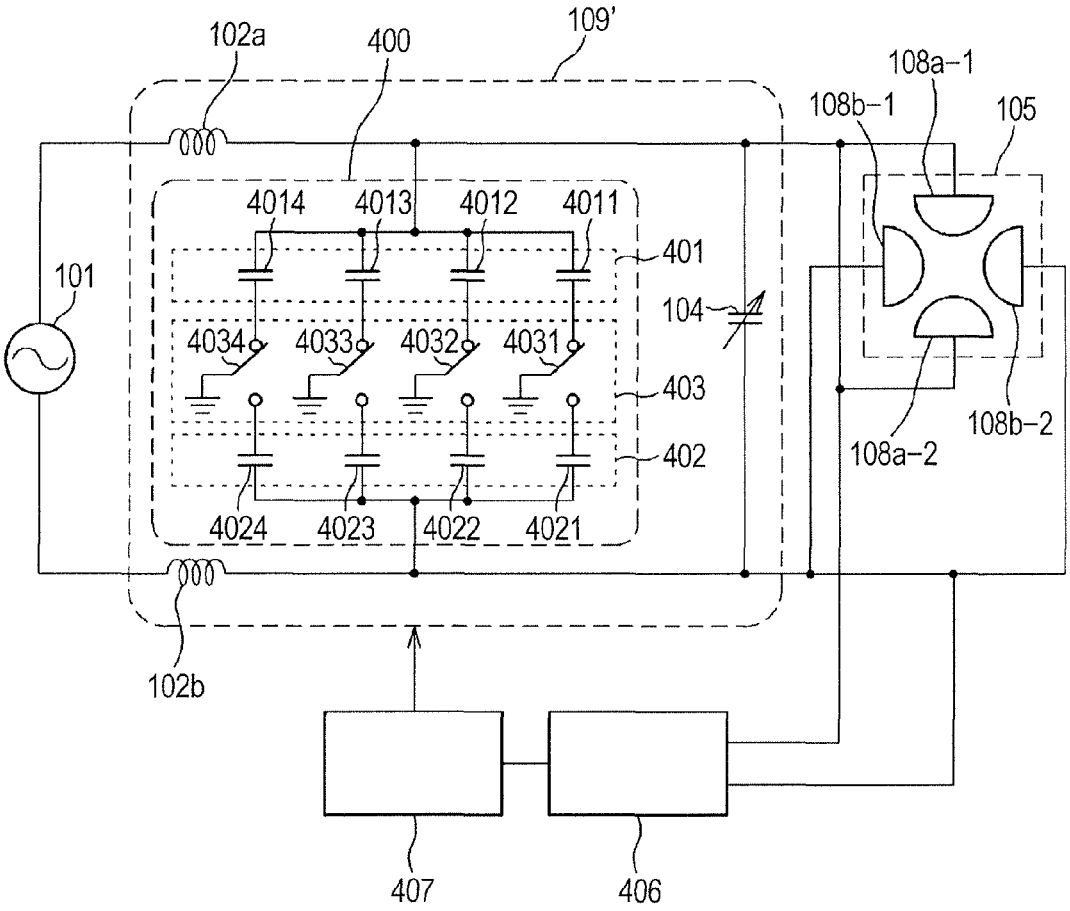
FIG. 4 is a block diagram illustrating a configuration of an ion trap section according to the second embodiment of the present invention.

The second embodiment of the ion trap section 1003 discloses a resonance circuit 109' in which the amplitude difference adjusting units 103*a*, 103*b* of the resonance circuit 109 in the first embodiment shown in FIG. 2 is replaced with the amplitude difference adjusting unit 400 that is constituted of capacitor arrays 401, 402 and a switch group 403 disposed therebetween as shown in FIG. 4.

In this embodiment, the amplitude difference adjusting unit is configured such that even when the adjustment amount of the amplitude difference is changed, the resonance frequency does not fluctuate.

More specifically, the amplitude difference adjusting unit 400 in this embodiment is configured to include: the capacitor array 401 constituted of capacitors 4011 to 4014 each having two terminals, one of which is connected to the one rod electrode pair 108*a*-1, 108*a*-2; the capacitor array 402 constituted of capacitors 4021 to 4024 each having two terminals, one of which is connected to the other rod electrode pair 108*b*-1, 108*b*-2; and the switch array 403 constituted of switches 4031 to 4034, each of which is configured to ground either of two electrodes which face each other between the capacitor arrays 401, 402.

The operation according to this embodiment will be described on the assumption that the capacitance of each capacitor is C, the capacitance viewed from the one rod electrode pair 108*a*-1, 108*a*-2 is $C_A$, the capacitance viewed from the other rod electrode pair 108*b*-1, 108*b*-2 is $C_B$, and the capacitance of all components constituting the resonance circuit 109' as the whole resonance circuit system is $C_T$.

When all of the switches 4031 to 4034 of the switch array 403 are connected to the capacitors 4011 to 4014 of the capacitor array 401 respectively, the capacitance of each capacitor is represented by the following equation:

$$C_A=4C$$

$$C_B=0$$

$$C_T=4C \qquad \text{(Equation 5)}$$

When one switch (for example, the switch 4031) of the switch array 403 is connected to the capacitor 4021 of the capacitor array 402, the capacitance of each capacitor is represented by the following equation:

$$C_A=3C$$

$$C_B=C$$

$$C_T=4C \qquad \text{(Equation 6)}$$

Similarly, when all of the switches 4031 to 4034 of the switch array 403 are connected to the capacitors 4021 to 4024 of the capacitor array 402, the capacitance $C_T$ of the whole resonance circuit system is 4C. In other words, the capacitance viewed from each rod electrode pair can be adjusted with the capacitance $C_T$ of the whole resonance circuit system kept constant, and therefore, even when the amplitude difference is adjusted, the difference between the resonance frequency and the drive frequency can be suppressed.

Figure 5:
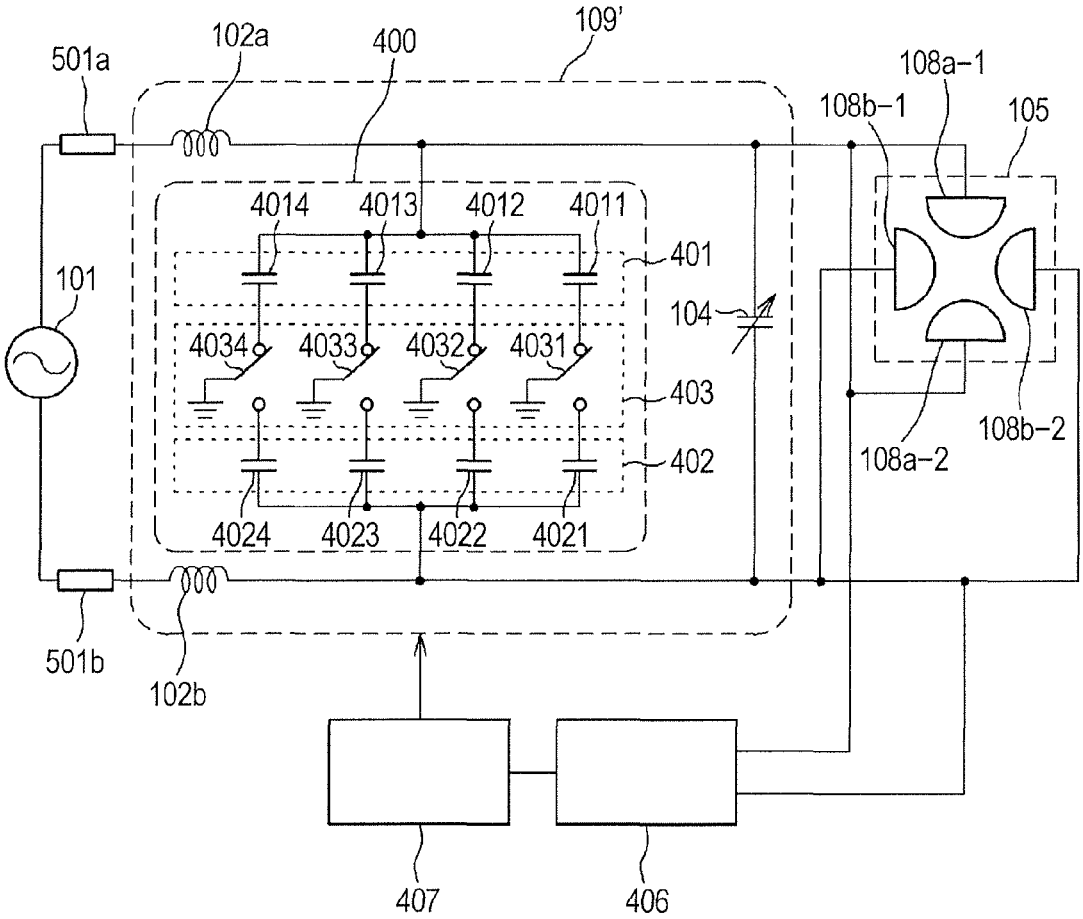
FIG. 5 is a block diagram illustrating a configuration in which resistive elements are inserted to decrease a Q value of a resonance circuit in the ion trap section according to the second embodiment of the present invention.

Here, the equations 5 and 6 are each used to simply calculate a capacitance value. Strictly speaking, the capacitance includes the capacitance between the rod electrode pairs, and thus the effective capacitance differs from that calculated by each of the above-mentioned equations. Therefore, the resonance frequency may slightly deviate from the drive frequency although the difference between the resonance frequency and the drive frequency can be suppressed in comparison with the method in the related art. If a Q value of the resonance circuit is very high (ex. Q=250), only a slight difference between the resonance frequency and the drive frequency may cause the amplification factor of the resonance circuit to rapidly decrease. In this case, as shown in FIG. 5, one of the useful measures is to insert a resistive element 501*a* between the RF circuit 101 and the coil 102*a*, and to insert a resistive element 501*b* between the RF circuit 101 and the coil 102*b*. Since the Q value of the resonance circuit can be decreased by inserting the resistive elements 501*a*, 501*b*, the sensitivity to the change in amplification factor of the resonance circuit caused by the difference between the resonance frequency and the drive frequency can be decreased.

By configuring the amplitude difference adjusting unit as above, it makes possible to suppress the difference between the resonance frequency and the drive frequency without controlling the frequency synchronizing unit, thereby enabling the simplification of the structure of the control unit. In addition, although the configuration of the capacitor array is shown here, the same effects can be achieved by, for example, a coil array constituted of inductance adjustable coils, or the like, insofar as the configuration of the coil array has the same feature.

Third Embodiment

Figure 6:
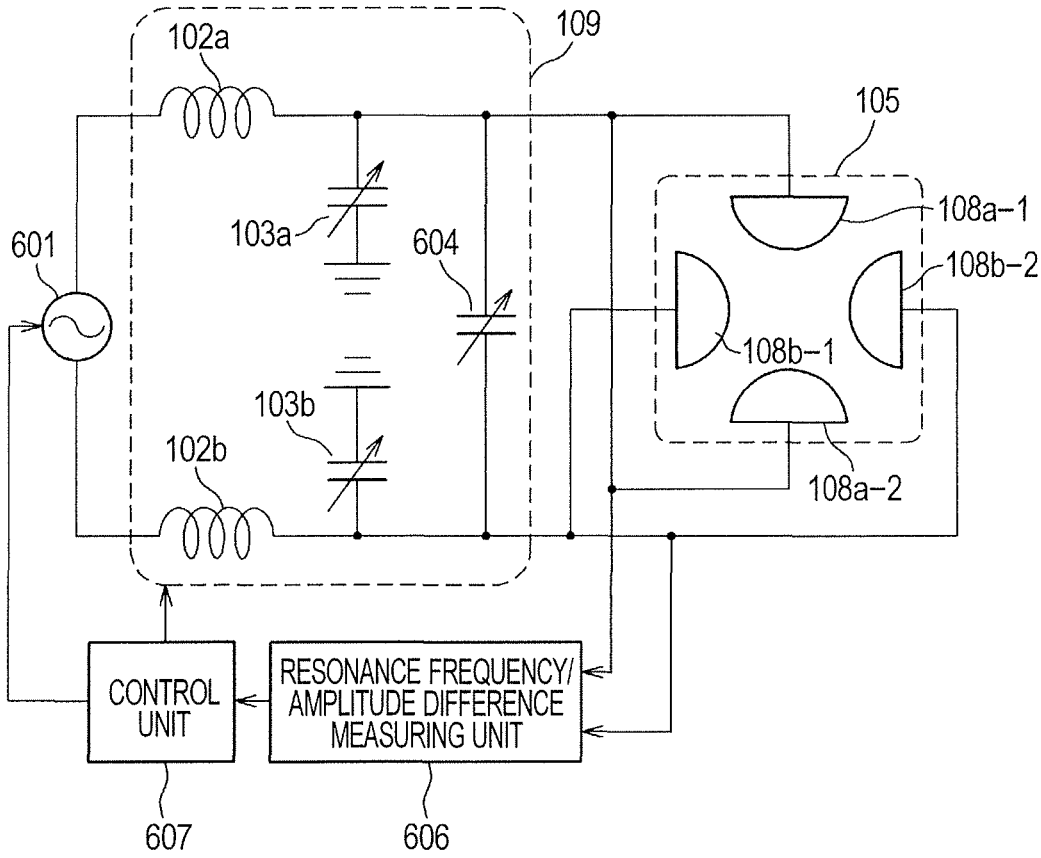
FIG. 6 is a block diagram illustrating a configuration of an ion trap section according to the third embodiment of the present invention.

The third embodiment of the ion trap section 1003 will be described as below. As shown in FIG. 6, the basic configuration of the ion trap section 1003 is similar to the configuration of the first embodiment shown in FIG. 2. However, the resonance frequency/amplitude difference measuring unit 606 is configured such that the RF signal source 601 having a frequency sweep function of sweeping the drive frequency of the RF signal is used, and when the control unit 607 controls the RF signal source 601 to perform frequency sweeping, the resonance frequency of the resonance circuit is measured, and the amplitude difference at the resonance frequency is measured.

In addition, the control unit 607 controls the frequency synchronizing unit 604 to align the drive frequency to the resonance frequency. In FIG. 6, elements provided with the same reference numerals with those shown in FIG. 2 have functions similar to those disclosed in the first embodiment.

Figure 7:
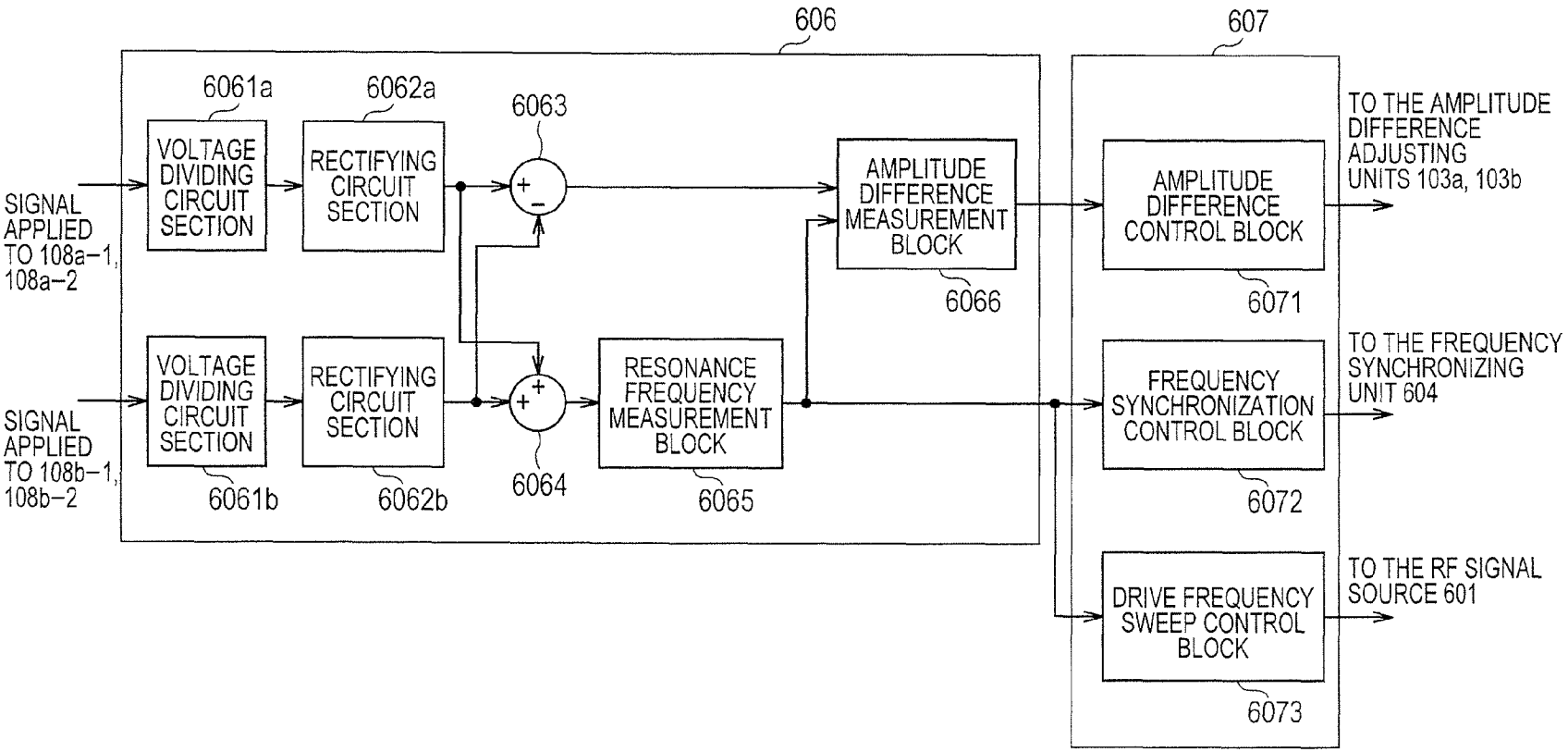
FIG. 7 is a block diagram illustrating in detail how a resonance frequency/amplitude difference measuring unit and a control unit are configured in the ion trap section according to the third embodiment of the present invention.

How the resonance frequency/amplitude difference measuring unit 606 and the control unit 607 are configured to implement the third embodiment will be described with reference to FIG. 7.

The resonance frequency/amplitude difference measuring unit 606 includes voltage dividing circuits 6061*a*, 6061*b*, rectifying circuits 6062*a*, 6062*b*, a subtracter 6063, an adder 6064, a resonance frequency measurement block 6065 and an amplitude difference measurement block 6066.

In addition, the control unit 607 includes an amplitude difference control block 6071 and a frequency synchronization control block 6072.

The high-voltage RF signal to be applied to the rod electrode pair 108*a*-1, 108*a*-2 and the high-voltage RF signal to be applied to the rod electrode pair 108*b*-1, 108*b*-2 are divided and inputted into the resonance frequency/amplitude difference measuring unit 606. The signal amplitude of the signal divided from the high-voltage RF signal to be applied to the rod electrode pair 108*a*-1, 108*a*-2 is decreased by the voltage dividing circuit 6061*a*, and the signal amplitude of the signal divided from the high-voltage RF signal to be applied to the rod electrode pair 108*b*-1, 108*b*-2 is decreased by the voltage dividing circuit 6061*b*.

The RF signal, the signal amplitude of which has been decreased by the voltage dividing circuit 6061*a*, is converted into a direct current signal by the rectifying circuit 6062*a*, and the RF signal, the signal amplitude of which has been decreased by the voltage dividing circuit 6061*b*, is converted into a direct current signal by the rectifying circuit 6062*b*. The direct current signals converted by the rectifying circuits 6062*a*, 6062*b* are then divided and inputted into the subtracter 6063 and the adder 6064 respectively. The adder 6064 obtains an added signal by adding the direct current signal converted by the rectifying circuit 6062*a* to the direct current signal converted by the rectifying circuit 6062*b*. The added signal is then inputted into the resonance frequency measurement block 6065, and a resonance frequency is detected from the added signal by the resonance frequency measurement block 6065.

Information about the resonance frequency detected by the resonance frequency measurement block 6065 is output to the amplitude difference measurement block 6066 and to the frequency synchronization control block 6072 of the control unit 607. The amplitude difference measurement block 6066 measures a value of the subtracted signal at the resonance frequency from: the subtracted signal output from the subtracter 6063, which has been obtained by subtracting the direct current signal converted by the rectifying circuit 6062*b* from the direct current signal converted by the rectifying circuit 6062*a*; and the information about the resonance frequency detected by the resonance frequency measurement block 6065.

In the control unit 607, the amplitude difference control block 6071 controls the amplitude difference adjusting units 103*a*, 103*b* of the resonance circuit 109 on the basis of the information about the value of the subtracted signal at the resonance frequency, which has been output from the amplitude difference measurement block 6066 of the resonance frequency/amplitude difference measuring unit 606. Meanwhile, the frequency synchronization control block 6072 controls the frequency synchronizing unit 104 of the resonance circuit 109 on the basis of the resonance frequency information which has been output from the resonance frequency measurement block 6065 of the resonance frequency/amplitude difference measuring unit 606.

Figure 8:
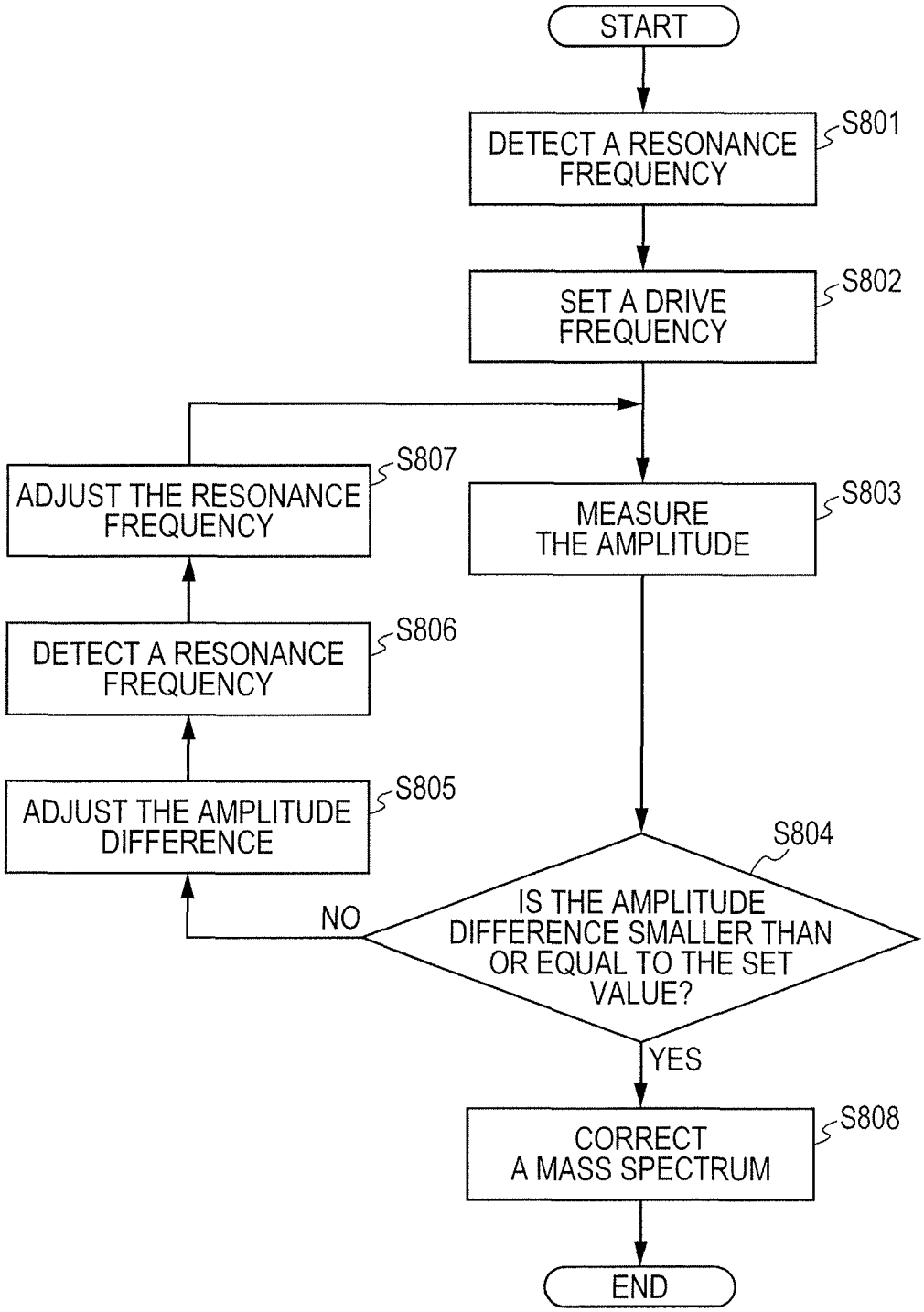
FIG. 8 is a flowchart illustrating the process flow of adjusting the amplitude difference and the drive frequency according to the third embodiment of the present invention.
Figure 9:
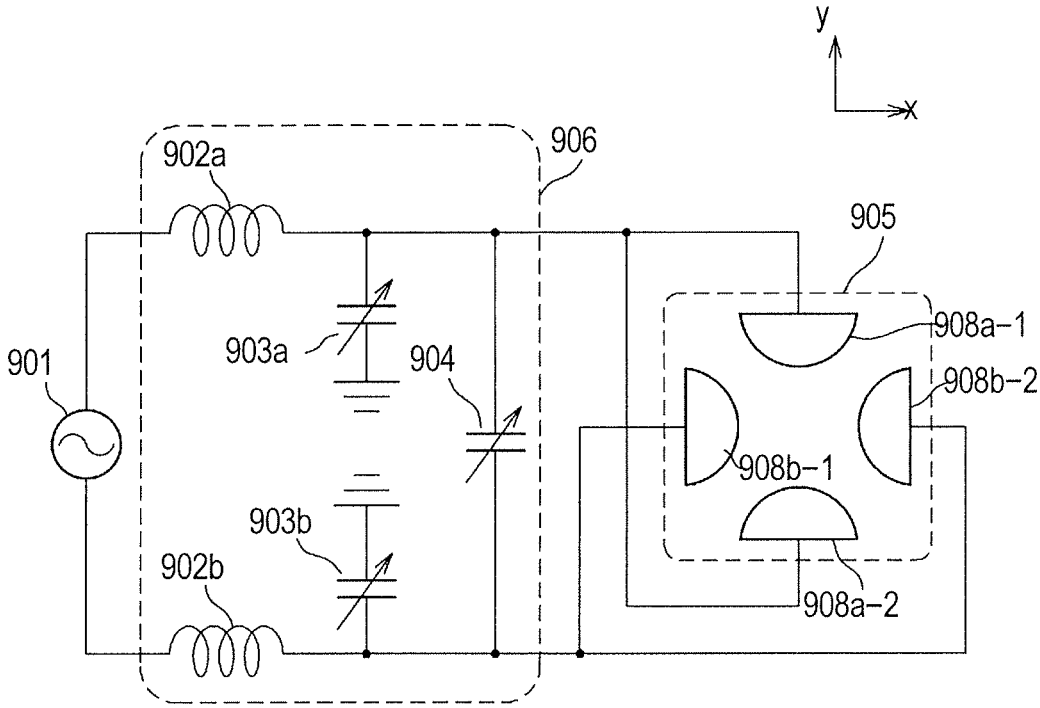
FIG. 9 is a block diagram illustrating a configuration of an ion trap section of a conventional mass spectroscope.
Figure 10A:
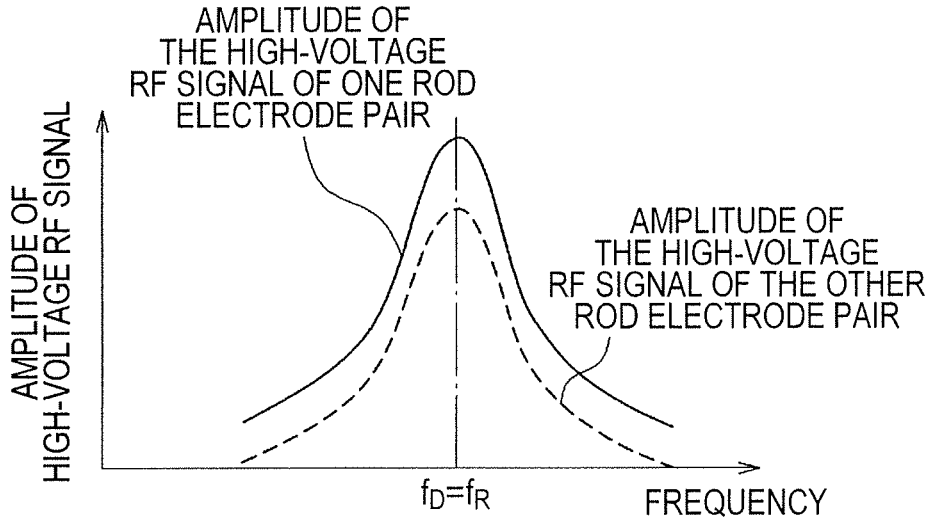
FIG. 10A is a graph illustrating the relationship between the amplitude of the high-voltage RF signal and the frequency, which shows the relationship between the resonance frequency and the drive frequency before the amplitude of a high-voltage RF signal is adjusted.
Figure 10B:
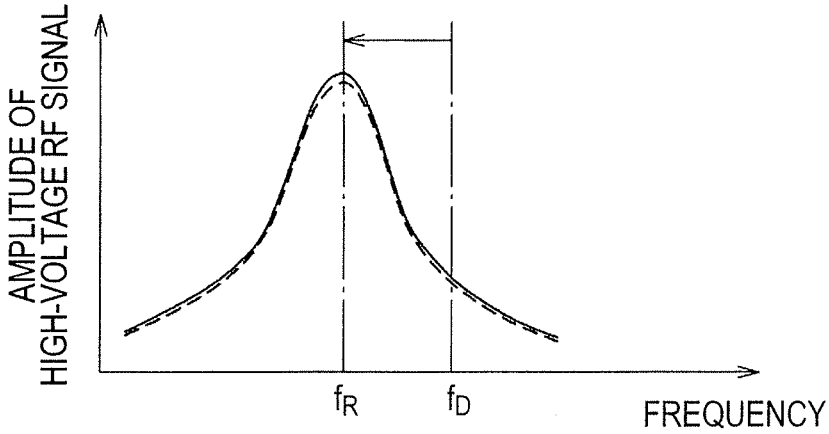
FIG. 10B is a graph illustrating the relationship between the amplitude of the high-voltage RF signal and the frequency, which shows the relationship between the resonance frequency and the drive frequency measured when the amplitude of the high-voltage RF signal is adjusted by a conventional method.

FIG. 8 is a flowchart in which the amplitude difference and the drive frequency are adjusted according to this embodiment. When the adjustment starts, first of all, while the drive frequency of the RF signal source 601 is changed by the drive frequency sweep control block 6073 of the control unit 607, the high-voltage RF signal at the drive frequency, which is to be applied to the rod electrode pair 108*a*-1, 108*a*-2, and the high-voltage RF signal at the drive frequency, which is to be applied to the rod electrode pair 108*b*-1, 108*b*-2, are divided and inputted into the resonance frequency/amplitude difference measuring unit 606. The voltage dividing circuits 6061*a*, 6061*b* decrease the amplitude of the inputted signals respectively, and subsequently the rectifying circuits 6062*a*, 6062*b* convert the signals into direct current signals respectively. The converted direct current signals are inputted into the adder 6064, and are then added to each other therein. The added signal is inputted into the resonance frequency measurement block 6065, and a drive frequency of the RF signal source 601 measured when the added signal is the largest is detected as a resonance frequency in the resonance frequency measurement block 6065 (S801). The drive frequency sweep control block 6073 sets the drive frequency of the RF signal source 601 at the resonance frequency (S802).

Meanwhile, the amplitude difference measurement block 6066 determines a difference in amplitude between the high-voltage RF signal at the resonance frequency, which is to be applied to the rod electrode pair 108*a*-1, 108*a*-2, and the high-voltage RF signal at the resonance frequency, which is to be applied to the rod electrode pair 108*b*-1, 108*b*-2. This difference is determined from the result of the subtraction by the subtracter 6063 into which the direct current signals converted by the rectifying circuits 6062*a*, 6062*b* are inputted, and the information about the resonance frequency detected by the resonance frequency measurement block 6065 (S803).

The amplitude difference control block 6071 of the control unit 607 compares the amplitude difference detected by the amplitude difference measurement block 6066 between the high-voltage RF signals at the resonance frequency, which are to be applied to the rod electrode pairs respectively, with a predetermined value (S804). When the amplitude difference between the high-voltage RF signals to be applied to the rod electrode pairs respectively is larger than the predetermined value, the amplitude difference control block 6071 controls the amplitude difference adjusting units 103*a*, 103*b* of the resonance circuit 109 to adjust the amplitude difference in such a manner that the amplitude difference between the high-voltage RF signals to be applied to the rod electrode pairs respectively decreases (S805). In this state, the high-voltage RF signal to be applied to the rod electrode pair 108*a*-1, 108*a*-2 and the high-voltage RF signal to be applied to the rod electrode pair 108*b*-1, 108*b*-2 are divided and inputted into the resonance frequency/amplitude difference measuring unit 606. The voltage dividing circuits 6061*a*, 6061*b* decrease the amplitude of the inputted signals respectively, and subsequently the rectifying circuits 6062*a*, 6062*b* convert the signals into direct current signals respectively.

The converted direct current signals are input into the adder 6064, and are then added to each other therein. The added signal is inputted into the resonance frequency measurement block 6065, and a resonance frequency of the resonance circuit 109 is then detected by the resonance frequency measurement block 6065 (S806). The frequency synchronizing unit 604 is adjusted in such a manner that the detected resonance frequency of the resonance circuit 109 is aligned with the drive frequency of the RF signal source 601 (S807). The process returns to the abovementioned step S803, and the amplitude difference between the high-voltage RF signals is determined therein.

Meanwhile, when the amplitude difference between the high-voltage RF signals to be applied to the rod electrode pairs respectively is smaller than or equal to the predetermined value, a correction coefficient of a mass spectrum is set according to the drive frequency of the RF signal source 601 (S808), and the adjustment ends.

The basic configuration described in the third embodiment is similar to the configuration of the first embodiment shown in FIG. 2. However, the configuration of the resonance circuit section 109 may be replaced with the configuration of the resonance circuit section 109' of the second embodiment as shown in FIG. 4 or 5.

According to the configuration described above, even when the resonance frequency has changed, the amplitude difference between the high-voltage RF signals at the resonance frequency can be measured, thereby enabling the correct control of the amplitude difference adjusting unit. In addition, the present invention relates to a method for adjusting the drive frequency in the frequency synchronizing unit, and therefore has the advantages of making the circuit size smaller in comparison with a case wherein the resonance frequency is adjusted, and enabling the adjustment by digital processing, by using, for example, a direct digital synthesizer in the RF circuit.

Incidentally, the present invention is not limited to the abovementioned embodiments, and includes various modified examples. For example, the above-mentioned embodiments are described in detail so as to clearly illustrate the present invention. Therefore, the present invention is not always limited to the invention having all of the disclosed configurations. In addition, the configuration of one embodiment can be partially replaced with the configuration of another embodiment. Moreover, to the configuration of each embodiment, a partial addition, deletion or replacement of the configuration of another embodiment can be made.

The invention may be embodied in other specific forms without departing from the spirit or essential characteristics thereof. The present embodiment is therefore to be considered in all respects as illustrative and not restrictive, the scope of the invention being indicated by the appended claims, rather than by the foregoing description, and all changes which come within the meaning and range of equivalency of the claims are therefore intended to be embraced therein.

The invention claimed is:

1. A mass spectroscope comprising:

a sample introduction chamber for introducing therein a sample;

an ionization chamber for ionizing the sample which has been introduced into the sample introduction chamber;

an ion trap section for separating the sample ionized in the ionization chamber according to the mass of the ions;

a detector for detecting ions having predetermined mass among the ions separated in the ion trap section; and a data processing unit for processing data obtained as the result of detecting the ions by the detector, wherein:

the ion trap section includes:

a rod electrode section having two pairs of rod electrodes (four rod electrodes in total), each pair of rod electrodes being disposed in such a manner that the rod electrodes of the pair face each other;

an RF signal source for generating an RF signal;

a resonance circuit unit for resonating and amplifying the RF signal generated by the RF signal source to generate a high-voltage RF signal, applying the high-voltage RF signal to one of the two rod electrode pairs, and applying the high-voltage RF signal, the phase of which is reversed from that of the high-voltage RF signal applied to the one of the two rod electrode pairs, to the other of the two rod electrode pairs, the rod electrodes of each rod electrode pair facing each other with respect to the central axis of the four rod electrodes of the rod electrode section;

a resonance frequency/amplitude difference measuring unit for measuring an amplitude difference between the high-voltage RF signal applied to the one of the two rod electrode pairs and the reversed-phase high-voltage RF signal applied to the other of the two rod electrode pairs, and measuring a resonance frequency of the resonance circuit unit; and a control unit for adjusting the resonance circuit unit on the basis of information about the amplitude difference between the high-voltage RF signals and the resonance frequency of the resonance circuit unit;

the resonance circuit unit includes:

a frequency synchronizing section for synchronizing the drive frequency of the RF signal source and the resonance frequency of the resonance circuit with each other; and an amplitude difference adjustment section for adjusting the amplitude difference between the high-voltage RF signals to a predetermined value; and the control unit controls the amplitude difference adjustment section of the resonance circuit unit to perform adjustment in such a manner that the amplitude difference between the high-voltage RF signals decreases, and controls the frequency synchronizing section of the resonance circuit unit to perform adjustment in such a manner that the resonance frequency of the resonance circuit is aligned with the drive frequency of the RF signal source, on the basis of the information about the amplitude difference between the high-voltage RF signals and the resonance frequency of the resonance circuit unit.

2. The mass spectroscope according to claim 1, wherein:

the amplitude difference adjustment section of the resonance circuit unit includes:

a first variable capacitor which is connected to a side of one of the two rod electrode pairs of the rod electrode section on which the high-voltage RF signal is applied; and a second variable capacitor which is connected to a side of the other of the two rod electrode pairs of the rod electrode section on which the high-voltage RF signal is applied.

3. The mass spectroscope according to claim 1, wherein:

the amplitude difference adjustment section of the resonance circuit unit includes:

a first plurality of capacitors which are connected in parallel to a side of one of the two rod electrode pairs of the rod electrode section on which the high-voltage RF signal is applied;

a second plurality of capacitors which correspond to the first plurality of capacitors respectively, and are connected in parallel to a side of the other of the two rod electrode pairs of the rod electrode section on which the high-voltage RF signal is applied; and a plurality of switches, each of which switches, to a grounded state, any of the first plurality of capacitors or any of the second plurality of capacitors which correspond to the first plurality of capacitors respectively.

4. The mass spectroscope according to claim 1, wherein:

the frequency synchronizing section of the resonance circuit unit includes a first variable capacitor which is connected to a side of the one of the two rod electrode pairs of the rod electrode section on which the high-voltage RF signal is applied, and a second variable capacitor which is connected to a side of the other of the two rod electrode pairs of the rod electrode section on which the high-voltage RF signal is applied.

5. A mass spectroscope comprising:

a sample introduction chamber for introducing therein a sample;

an ionization chamber for ionizing the sample which has been introduced into the sample introduction chamber;

an ion trap section for separating the sample ionized in the ionization chamber according to the mass of the ions;

a detector for detecting ions having predetermined mass among the ions separated in the ion trap section; and a data processing unit for processing data obtained as the result of detecting the ions by the detector, wherein:

the ion trap section includes:

a rod electrode section having two pairs of rod electrodes (four rod electrodes in total), each pair of rod electrodes being disposed in such a manner that the rod electrodes of the pair face each other;

an RF signal source for generating an RF signal;

a resonance circuit unit for resonating and amplifying the RF signal generated by the RF signal source to generate a high-voltage RF signal, applying the high-voltage RF signal to one of the two rod electrode pairs, and applying the high-voltage RF signal, the phase of which is reversed from that of the high-voltage RF signal applied to the one of the two rod electrode pairs, to the other of the two rod electrode pairs, the rod electrodes of each of the rod electrode pair facing each other with respect to the central axis of the four rod electrodes of the rod electrode section;

a resonance frequency/amplitude difference measuring unit for measuring an amplitude difference between the high-voltage RF signal applied to the one of the two rod electrode pairs and the reversed-phase high-voltage RF signal applied to the other of the two rod electrode pairs, and measuring a resonance frequency of the resonance circuit unit; and a control unit for adjusting the resonance circuit unit on the basis of information about the amplitude difference between the high-voltage RF signals and the resonance frequency of the resonance circuit unit;

the resonance circuit unit includes:

a frequency synchronizing section for synchronizing the drive frequency of the RF signal source and the resonance frequency of the resonance circuit with each other; and an amplitude difference adjustment section for adjusting the amplitude difference between the high-voltage RF signals to a predetermined value; and the control unit includes:

an amplitude difference control section for controlling the amplitude difference adjustment section of the resonance circuit unit on the basis of the information about the amplitude difference between the high-voltage RF signals and the resonance frequency of the resonance circuit unit; and a frequency synchronization control section for controlling the frequency synchronizing section of the resonance circuit unit.

6. The mass spectroscope according to claim 5, wherein:

the resonance frequency/amplitude difference measuring unit includes:

a first voltage dividing section for dividing the voltage of the high-voltage RF signal applied to the one of the two rod electrode pairs;

a first rectifying circuit section for rectifying the RF signal whose voltage has been divided from the high-voltage RF signal by the first voltage dividing section;

a second voltage dividing section for dividing the voltage of the reversed-phase high-voltage RF signal applied to the other of the two rod electrode pairs;

a second rectifying circuit section for rectifying the RF signal whose voltage has been divided from the high-voltage RF signal by the second voltage dividing section;

an adder for obtaining a signal by adding a first direct current signal rectified by the first rectifying circuit section to a second direct current signal rectified by the second rectifying circuit section; and a resonance frequency measuring section for determining a resonance frequency of the resonance circuit unit on the basis of the added signal obtained from the first direct current signal and the second direct current signal by the adder; and the control unit includes a frequency synchronization control section for, on the basis of the information about the resonance frequency of the resonance circuit unit determined by the resonance frequency measuring section, controlling the frequency synchronizing section in such a manner that the resonance frequency of the resonance circuit is synchronized with the drive frequency of the RF signal source.

7. The mass spectroscope according to claim 6, wherein:

the resonance frequency/amplitude difference measuring unit further includes:

a subtracter for obtaining a difference signal between the first direct current signal rectified by the first rectifying circuit section and the second direct current signal rectified by the second rectifying circuit section; and an amplitude difference measuring section for, on the basis of the difference signal between the first direct current signal and the second direct current signal obtained by the subtracter, determining an amplitude difference between the high-voltage RF signal applied to the one of the two rod electrode pairs and the reversed-phase high-voltage RF signal applied to the other of the two rod electrode pairs at the resonance frequency of the resonance circuit unit determined by the resonance frequency measuring section; and the control unit further includes an amplitude difference control section for controlling the amplitude difference adjustment section of the resonance circuit unit on the basis of the amplitude difference between the high-voltage RF signal applied to the one of the two rod electrode pairs and the reversed-phase high-voltage RF signal applied to the other of the two rod electrode pairs measured by the amplitude difference measuring section.

8. The mass spectroscope according to claim 5, wherein:

the control unit includes a drive-frequency sweep control section for sweeping a frequency of the high-voltage RF signal generated by the RF signal source.

9. A method for adjusting a mass spectroscope, the method comprising the steps of:

resonating and amplifying, by a resonance circuit, an RF signal generated by an RF signal source to generate a high-voltage RF signal;

providing a rod electrode section with two pairs of rod electrodes (four rod electrodes in total), each pair of rod electrodes being disposed in such a manner that the rod electrodes of the pair face each other with respect to the central axis of the four rod electrodes, applying the generated high-voltage RF signal to one of the tow rod electrode pairs, and applying the generated high-voltage RF signal to the other of the two rod electrode pairs with the phase of the high-voltage RF signal reversed from that of the high-voltage RF signal applied to the one of the two rod electrode pairs;

measuring an amplitude difference between the high-voltage RF signal applied to the one of the two rod electrode pairs and the reversed-phase high-voltage RF signal applied to the other of the two rod electrode pairs, and a resonance frequency of the resonance circuit; and adjusting the resonance circuit on the basis of information about the measured amplitude difference between the high-voltage RF signals and the measured resonance frequency of the resonance circuit, wherein:

on the basis of the information about the amplitude difference between the high-voltage RF signal applied to the rod electrodes and the reversed-phase high-voltage RF signal applied to the rod electrodes, and the information about the resonance frequency of the resonance circuit, the resonance circuit is adjusted in such a manner that the amplitude difference decreases, and in such a manner that the resonance frequency of the resonance circuit is aligned with a frequency of the RF signal.

10. The mass spectroscope adjusting method according to claim 9, wherein:

the adjustment of the resonance circuit in such a manner that the amplitude difference decreases is achieved by adjusting the capacitance of a first variable capacitor which is connected to a side of one of the two rod electrode pairs of the rod electrode section on which the high-voltage RF signal is applied, and the capacitance of a second variable capacitor which is connected to a side of the other of the two rod electrode pairs of the rod electrode section on which the high-voltage RF signal is applied.

11. The mass spectroscope adjusting method according to claim 9, wherein:

the adjustment of the resonance circuit in such a manner that the amplitude difference decreases is achieved by switching, to a grounded state, either a first plurality of capacitors which are connected in parallel to a side of one of the two rod electrode pairs of the rod electrode section on which the high-voltage RF signal is applied or a second plurality of capacitors which correspond to the first plurality of capacitors respectively, and are connected in parallel to a side of the other of the two rod electrode pairs of the rod electrode section on which the reversed-phase high-voltage RF signal is applied.

12. The mass spectroscope adjusting method according to claim 9, wherein:

the adjustment of the resonance circuit in such a manner that the resonance frequency of the resonance circuit is aligned with the frequency of the RF signal is achieved by adjusting the capacitance of a variable capacitor which is connected to a side of one of the two rod electrode pairs of the rod electrode section on which the high-voltage RF signal is applied, and the capacitance of a variable capacitor which is connected to a side of the other of the two rod electrode pairs of the rod electrode section on which the reversed-phase high-voltage RF signal is applied.

13. A method for adjusting a mass spectroscope that includes a rod electrode section having two pairs of rod electrodes (four rod electrodes in total), each pair of rod electrodes being disposed in such a manner that the rod electrodes of the pair face each other, the method comprising the steps of:

detecting a resonance frequency of a resonance circuit which resonates and amplifies an RF signal generated by an RF signal source to generate a high-voltage RF signal;

setting a drive frequency of the RF signal source in such a manner that the drive frequency is synchronized with the detected resonance frequency of the resonance circuit;

resonating and amplifying, by the resonance circuit, an RF signal generated by the RF signal source at the set drive frequency, thereby generating a high-voltage RF signal;

providing the rod electrode section with two pairs of rod electrodes, each pair of rod electrodes being disposed in such a manner that the rod electrodes of the pair face each other with respect to the central axis of the four rod electrodes, applying the generated high-voltage RF signal to one of the two rod electrode pairs, and applying the generated high-voltage RF signal to the other of the two rod electrode pairs with the phase of the high-voltage RF signal reversed from that of the high-voltage RF signal applied to the one of the two rod electrode pairs;

detecting an amplitude difference between the high-voltage RF signal applied to the one of the two rod electrode pairs and the reversed-phase high-voltage RF signal applied to the other of the two rod electrode pairs;

comparing the detected amplitude difference with a predetermined value;

when the detected amplitude difference is larger than the predetermined value, adjusting the resonance circuit in such a manner that the amplitude difference decreases; and when the detected amplitude difference is smaller than or equal to the predetermined value, setting a correction coefficient of a mass spectrum according to the drive frequency.

14. The mass spectroscope adjusting method according to claim 13, further comprising the steps of:

when the detected amplitude difference is larger than the predetermined value, adjusting the resonance circuit in such a manner that the amplitude difference decreases, and then detecting the resonance frequency of the resonance circuit again;

adjusting the resonance circuit in such a manner that the detected resonance frequency of the resonance circuit is synchronized with the set drive frequency of the RF signal source;

applying the generated high-voltage RF signal, which is resonated and amplified by the adjusted resonance circuit, to one of the two rod electrode pairs, and applying the generated high-voltage RF signal to the other of the two rod electrode pairs with the phase of the high-voltage RF signal reversed from that of the high-voltage RF signal applied to the one of the two rod electrode pairs, the rod electrodes of each of the rod electrode pair facing each other with respect to the central axis of the four rod electrodes of the rod electrode section; and detecting an amplitude difference between the high-voltage RF signal applied to the one of the two rod electrode pairs and the reversed-phase high-voltage RF signal applied to the other of the two rod electrode pairs.

* * * * *